US008202132B2

(12) United States Patent
Silva et al.

(10) Patent No.: US 8,202,132 B2
(45) Date of Patent: Jun. 19, 2012

(54) CONTACT SPRING FOR VEHICULAR ANTENNA/AMPLIFIER CONNECTION

(75) Inventors: David Silva, Nürtigen (DE); Helmut Häussler, Aichtal (DE)

(73) Assignee: Hirschmann Car Communication GmbH, Neckartenzlingen (DE)

( * ) Notice: Subject to any disclaimer, the term of this patent is extended or adjusted under 35 U.S.C. 154(b) by 532 days.

(21) Appl. No.: 11/989,094

(22) PCT Filed: Apr. 10, 2006

(86) PCT No.: PCT/EP2006/003242

§ 371 (c)(1), (2), (4) Date: Aug. 4, 2009

(87) PCT Pub. No.: WO2007/009511

PCT Pub. Date: Jan. 25, 2007

(65) Prior Publication Data

US 2009/0305579 A1 Dec. 10, 2009

(30) Foreign Application Priority Data

Jul. 19, 2005 (DE) ..... 10 2005 033 593

(51) Int. Cl.
*H01R 4/48* (2006.01)

(52) U.S. Cl. ..... 439/816; 439/886

(58) Field of Classification Search ..... 439/816, 439/825, 839, 886, 927; 174/32, 351, 355, 174/396; 277/920; 361/800, 816, 818
See application file for complete search history.

(56) References Cited

U.S. PATENT DOCUMENTS

| | | | | |
|---|---|---|---|---|
| 5,360,355 | A * | 11/1994 | Ehrler et al. | 439/816 |
| 6,500,012 | B1 * | 12/2002 | Billenstein et al. | 439/92 |
| 7,078,614 | B1 * | 7/2006 | Van Haaster | 174/355 |
| 2002/0004344 | A1 * | 1/2002 | Keiser et al. | 439/816 |

* cited by examiner

*Primary Examiner* — Tulsidas C Patel
*Assistant Examiner* — Travis Chambers
(74) *Attorney, Agent, or Firm* — Andrew Wilford

(57) ABSTRACT

A pair of confronting and spaced contact surfaces of a predetermined conductive material are electrically interconnected by a spring-type contact that is between the surfaces. The contact has an anchored end secured to one of the surfaces, an opposite free end, and a plurality of blades unitary with and extending between the ends and each having a bowed section engaging a respective contact surface. These bowed sections of the contact extend in opposite directions toward the contact surfaces and form contact points engageable with the respective contact surfaces. A coating on each of the contact points is of a material matched to the conductive material of the contact surfaces.

8 Claims, 4 Drawing Sheets

CONTACT SPRING FOR VEHICULAR ANTENNA/AMPLIFIER CONNECTION

CROSS REFERENCE TO RELATED APPLICATIONS

This application is the US national stage of PCT application PCT/EP2006/003242, filed 10 Apr. 2006, published 25 Jan. 2007 as WO2007/009511, and claiming the priority of German patent application 102005033593.4 itself filed 19 Jul. 2005, whose entire disclosures are herewith incorporated by reference.

FIELD OF THE INVENTION

The invention relates to a spring-type contact for conducting electricity between a pair of juxtaposed but spaced contact surfaces.

PRIOR ART

A spring-type contact that has blades each turned toward a respective contact surfaces, the blades having contact points movable into contact with the contact surfaces, is described in EP 1 523 069 [U.S. Pat. No. 7,121,835]. The spring-type contact described and illustrated therein has an anchored end by which the spring-type contact can be anchored in or onto a support frame. One free end remote from the anchored end can move in a recess of the support frame in one direction, this movement being critical when the spring-type contact is brought and thereby compressed between the two contact surfaces. Practice has shown that the design of this type of spring-type contact with upwardly and downwardly projecting blades is quite advantageous since damage from the closed blades can be prevented, and even extreme compression of the blades does not result breaking the blades since the free end is able to move axially, thereby providing a longitudinal compensating movement.

These known spring-type contacts are employed primarily for connecting antenna amplifiers to antenna structures that are located in or on a two-dimensional component of a vehicle, in particular, a window.

An approach is known from EP 1 080 513 [U.S. Pat. No. 6,411,259] in which a support frame made of plastic is glued onto the two-dimensional component of the vehicle (here the rear window) and the printed-circuit board of an antenna amplifier is fitted to the frame. At the points at which contact with to the contacts of the vehicle window are to be effected, the printed-circuit board of the antenna amplifier has soldered-on and projecting spring-type contacts that are designed as contact arms having free projecting ends. There is a danger here that these projecting spring-type contacts can be bent over or broken off, in particular when the antenna amplifier is made at a supplier of the vehicle manufacturer and subsequently shipped to the production site of the vehicle. If these projecting spring-type contacts are bent, the requisite spring characteristic is distorted, or in the worst case made unusable, with the result that no contact can be made with the contact on the vehicle window or insufficient contact pressure is provided. This is the reason the blade spring-type contacts of EP 1 523 069 are employed instead of the spring-type contacts known from EP 1 080 513 that are soldered onto the printed-circuit board of the antenna amplifier.

Tests on spring-type contacts that have a geometry based on EP 1 523 069 have shown, however, that these blade spring-type contacts as known per se need improvement.

OBJECT OF THE INVENTION

The basic object to be attained by the invention is to further improve the known blade spring-type contacts so as to optimize them with respect to their use in contacting electronic devices, in particular, antenna amplifiers, in vehicles having electrically conductive structures in two-dimensional components, in particular, antenna structures in vehicle windows.

SUMMARY OF THE INVENTION

According to the invention the at least one contact point of the spring-type contact has a coating, preferably, the contact points of the spring-type contacts have a coating, wherein the material of the coating of the spring-type contact is matched to the material of the contact surface. This means that the spring-type contact is composed of a first material that will be designated as the base material. In and adjacent the regions where bowed sections of the blades are likely to be brought into contact with the contact surfaces, the base material of the spring-type contact has the same material as the contact surface itself. This enables corrosion of the contact to be largely prevented or even completely prevented. If the base material of the spring-type contact is a material different from the one contact surface, or is different from both contact surfaces, provision is made whereby the contact points of the blades of the spring-type contact are provided with the same material as that forming the contact surface so that the regions contacting each other are composed of the same material. This means that the coating of the contact points of the spring-type contact is composed of the same material as the contact surfaces with which the blades are able to be brought into contact. It is perfectly conceivably here that the base material of the spring-type contact is composed of a first material, the two contact surfaces are composed of materials different from this material, and the contact points of the blades are coated with the materials with which they are subsequently able to be brought into contact with. This effectively prevents a situation whereby upon contact between materials of different electrical conductivity, the more noble type is corroded and broken down. This means, in other words, that the material of the contact surface and the material of the contact point of the blade are matched to each other in terms of their electrical properties so as to largely, or even completely, prevent any corrosion and breakdown of the contact surfaces. The coating of the contact points of the blades can, e.g. be done by electroplating, it being conceivable that electrically conductive materials are deposited that are mixed with electrically conductive materials (keyword: electrically conductive plastic). In a typical application, the contact surface on the vehicle window which the antenna conductor structure is to contact is composed, e.g. of silver, while the contact surface at the end point of the conductive track of the antenna amplifier is composed of gold. If the base material of the spring-type contact were entirely spring sheet metal only, the result could be the described breakdown phenomena due to the different electrochemical series of the metal materials. This is prevented by the invention in that the blades turned toward the contact surface of the vehicle window are coated with silver, whereas the blades turned toward the contact surface on the printed-circuit board of the antenna amplifier are coated with gold, while the base material of the spring-type contact has a metal that has good spring properties.

In a complementary or alternative embodiment of the invention, provision is made whereby the number of blades turned toward the one contact surface and/or their width is different from the number of blades and/or their width turned toward the other contact surface. This provides the advantage that different contact forces can be applied since based on their dimensions and/or materials different contact surfaces require different contact forces, which can be optimally adjusted by means of the number of blades and/or their width. In particular, the use of narrower blades enables the contact force to be reduced, and thus the abrasive wear around the contact surface also to be reduced. At the same time, e.g. given narrower blades, the requisite spring forces can be provided by the higher number of blades. If, however, the spring force should be equal on both sides of the spring-type contact, the combined width of all blades on each side of the spring-type contact can be the same. This means that given a different width and different number of blades on the one and the other side, the spring force or spring travel is nevertheless equal. If, however, different spring forces and/or spring travels are required, this can also be provided by the design of the blades according to the invention. If, however, the contact force should be equal on both sides of the spring-type contact, the total number of blades on each side of the spring-type contact can also be same. All of this can be adjusted in a specific and targeted manner in the spring-type contact according to the invention since this spring is anchored only at one end and has a free end, with the result that a specific, and most importantly, known length compensation is possible here. With a spring-type contact that is anchored at both ends, this specific and targeted design would not be possible.

In a further embodiment of the invention, provision is made whereby the anchored end of the spring-type contact is fixable in only one predetermined position on a support, support frame, support plate, or the like. To this end, in an especially advantageous approach, the anchored end of the spring-type contact and/or the attachment region of the support to which the anchored end of the spring-type contact is anchored, is designed to have a shape such that only one positioning of the spring-type contact on the support is possible. To this end, there are various design shapes, just as there are various ways of attachment, that will be discussed in more detail with reference to the description of the figures. The correct orientation of the spring-type contact in or on the support frame is critical since first of all this enables automated assembly—advantageous specifically for large production runs. This also precludes differently dimensioned spring-type contacts from being used in the same support frame. This is critical specifically whenever the spring-type contact is, e.g. matched to a predetermined spacing between the two contact surfaces and this spacing can vary, e.g. with different vehicle models. The correct orientation of the spring-type contact within the support frame is also critical in order to place the spring with the correct lateral orientation into the support frame given different contact surfaces and/or contact forces.

BRIEF DESCRIPTION OF THE DRAWING

Embodiments of the invention are illustrated in FIGS. 1 through 6, although the invention is not limited to these embodiments. In the drawing.

DETAILED DESCRIPTION

Figure 1:
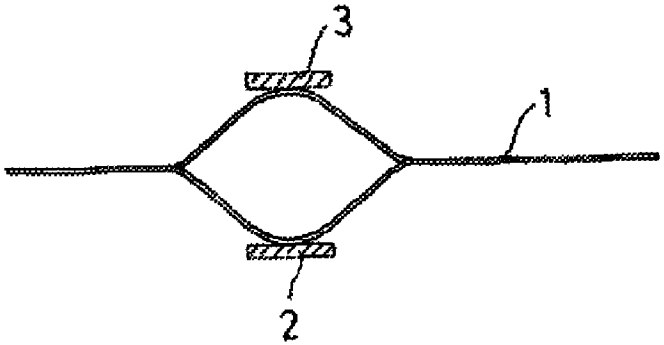
FIG. 1 shows the basic configuration of a spring-type contact of blade design.

FIG. 1 shows, to the extent details are illustrated, the basic configuration of a spring-type contact 1 of blade design between two contact surfaces 2 and 3, where e.g. contact surface 2 is on a face of a printed-circuit board of an antenna amplifier while contact surface 3 is mounted on a face of a two-dimensional component of a vehicle having an antenna conductor structure. A basic design of this type in terms of the constructive details, as shown in FIG. 1, is known from EP 1 080 513.

Figure 2:
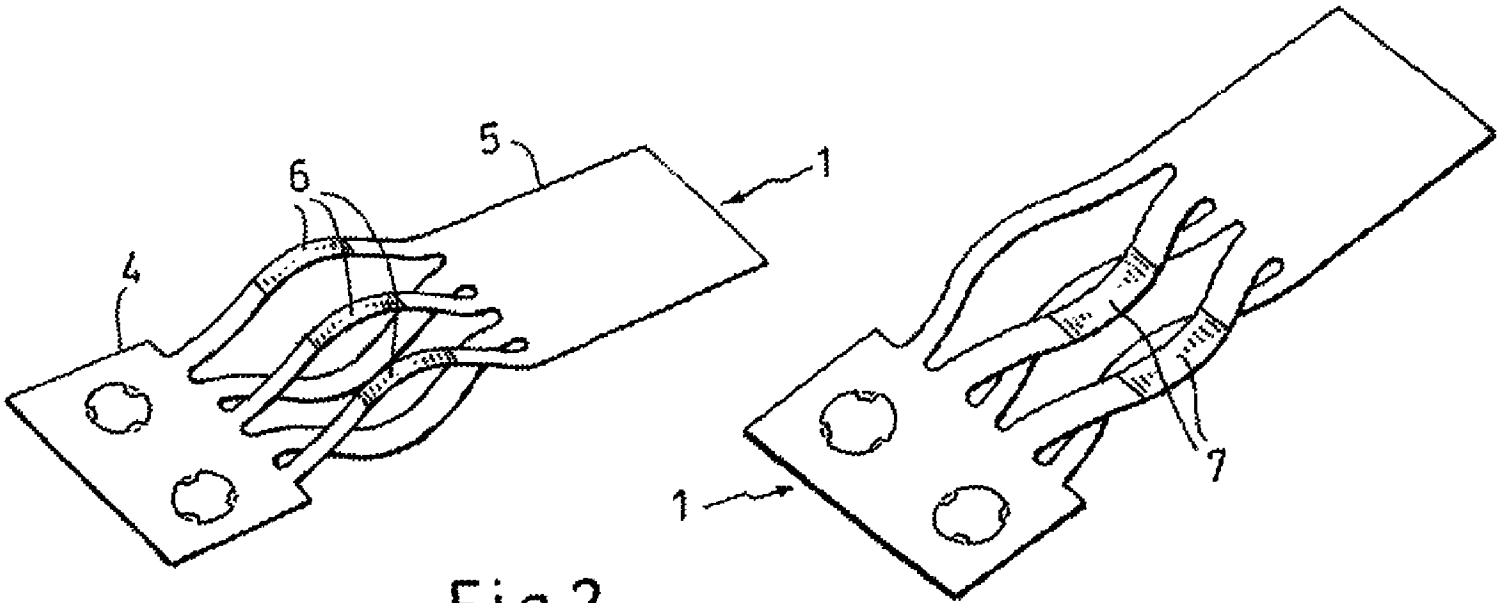
FIG. 2 shows the spring-type contact made of a base material with spring properties and has an anchored end as well as a freely movable end.

FIG. 2 shows that spring-type contact 1 is composed of a base material having spring properties and has an anchored end 4 as well as a freely movable end 5. A blade connection, one side turned toward the contact surface 2 and the other side turned toward the contact surface 3, is provided between these two ends 4 and 5. This design shape shown in FIG. 2 for spring-type contact 1 can be produced by a simple stamping process. FIG. 2 also shows that the bowed top and bottom regions, where the blades contact the contact surfaces 2 and 3 at contact points 6 and 7, are coated with different materials. It is critical here that contact points 6 and 7 are dimensioned such that at their specified installation site they completely contact the surfaces 2 and 3, or optionally extend beyond them, after the spring-type contact 1 is installed. This complete overlaying of the contact points 6 and 7 on the respective contact surfaces 2 and 3 enables contact corrosion and abrasive wear to be prevented.

Figure 3:
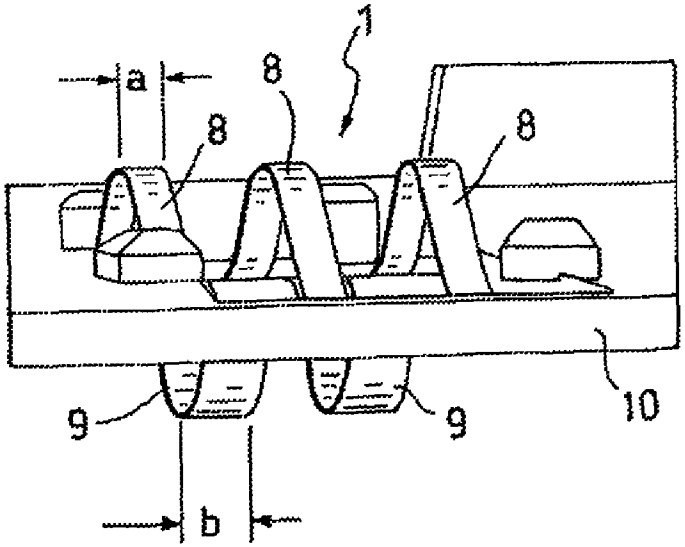
FIG. 3 shows the spring-type contact with upwardly and downwardly projecting blades.

FIG. 3 shows spring-type contact 1 with upwardly projecting blades 8 and downwardly projecting blades 9, the blades 8 having a width "a" with three being provided, while the downwardly projecting blades have a width "b" with only two being provided. Based on this dimensioning, the combined width of the three blades 8 is equal in size to the combined width of the blades 9, so that $3 \times a = 2 \times b$ applies and yields the same springiness (spring travel, spring force). This means in general that the number of blades and/or their width turned toward the one contact surface is different from, or if desired also the same as, the number of blades and/or their width turned toward the other contact surfaces, thereby enabling equal or different contact forces, or equal or different spring travels, to be set. Thus, for example, the contact force can be reduced (spring force by the number of blades yields the contact force) by using narrower blades, thereby also making it possible to reduce or even prevent abrasive wear on contact surface 2 and 3, since when spring-type contact 1 is stressed by an axial force (see FIG. 4) the freely moving end 5 of the spring-type contact can move freely without spring-type contact 1 itself bending so as to deform.

Figure 4:
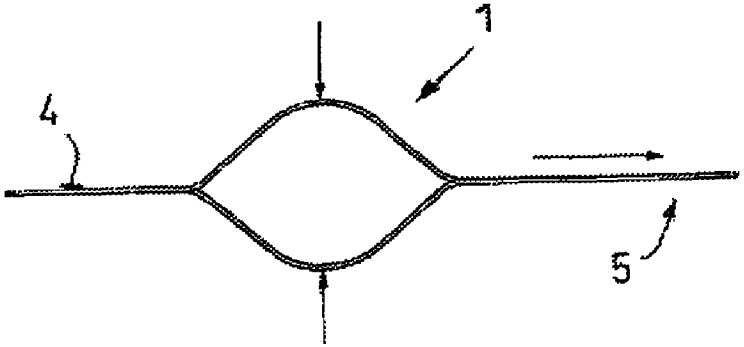
FIG. 4 shows the spring-type contact anchored by its anchored end to an unillustrated support such that the freely movable end can move whenever axial forces act on the spring-type contact.

FIG. 4 shows spring-type contact 1 that is anchored by its attachment point 4 to a support, not shown, thereby enabling the freely movable end 5 of spring-type contact 1 to move in the direction of the arrow, or opposite to the direction of the arrow, when axial forces from above or below act on the blades during and after installation of the spring-type contact. This means that the axial forces acting from above and below effect a deflection of freely moving end 5, while at the same time, however, the requisite contact forces or spring travels are retained.

Figure 5:
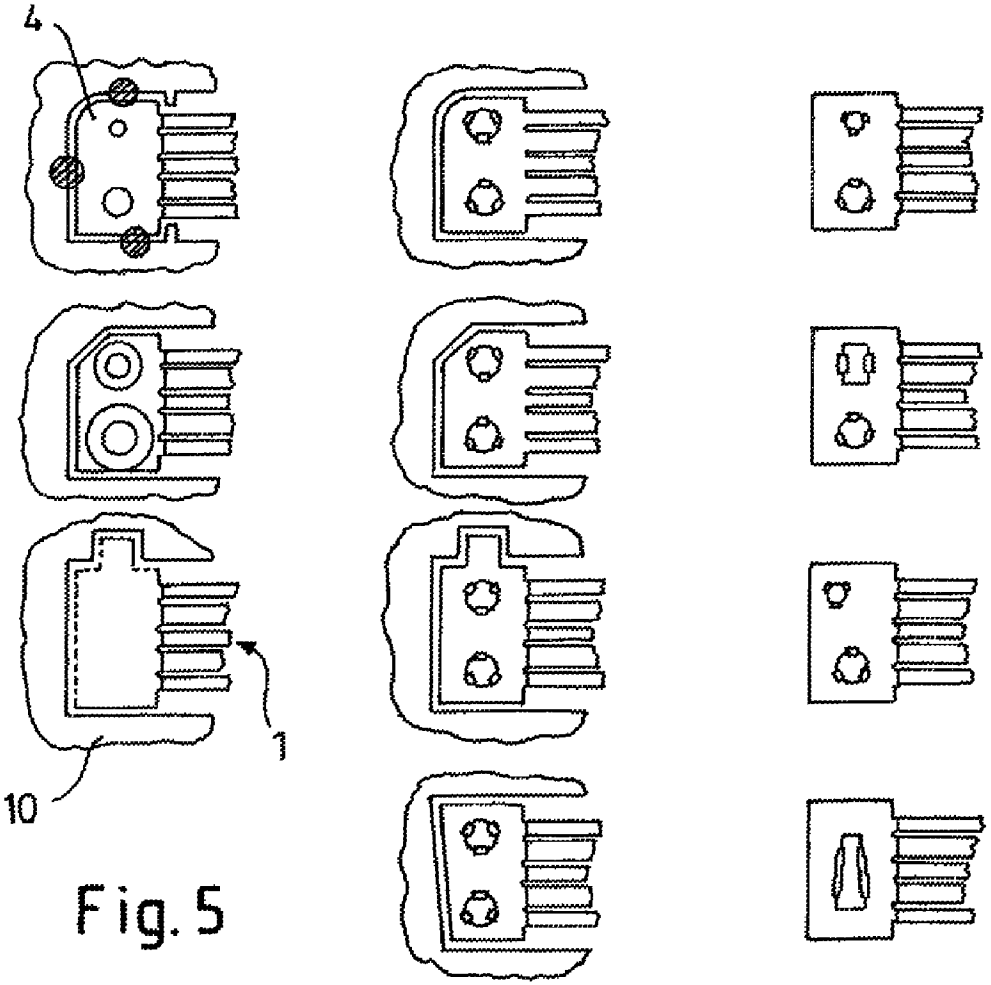
FIG. 5 shows the spring-type contact in a support (in particular, a support frame for holding a printed-circuit board of an antenna amplifier) with coding to ensure a correct orientation.

Finally, FIG. 5 shows spring-type contact 1 in a support 10 (in particular, a support frame to accommodate the printed-circuit board of an antenna amplifier), the shape of the anchored end 4 of the spring-type contact 1, and the associated attachment region of the spring-type contact 1 to the support 10 allowing attachment of the spring-type contact 1 to the support 10 only in one predetermined position due to the spring's shape. There are multiple possible approaches for this specific coding and attachment of the spring-type contact 1 to the support, these approaches being illustrated schematically in the figure. Thus, for example, the anchored end 4 of the spring-type contact 1 can be rounded, beveled, provided with notches or bulges or asymmetrical shapes, and the support 10 can have a shape corresponding thereto. If for example one corner of the anchored end 4 of the spring-type contact 1 is beveled, the corresponding region in or on the support 10 similarly has a complementary shape, e.g. a recess into which the anchored end 4 is inserted, or based on a correspondingly provided angled segment. In addition, it also possible (see right third of FIG. 5) to implement the coding by fastening means, such as, e.g. locating hooks, locating lugs, barbs, or the like. For example, the support 10 can have two projecting spurs of different diameter, while the anchored end 4 has two complementary openings also of different diameter. In general, attachment of the spring-type contact 1 to the support 10 is effected by nonpositive or positive engagement, such as, e.g. by caulking, hot-foil stamping, ultrasonic welding, adhesive bonding, detents, screws, or the like. In addition, an approach is additionally conceivable whereby a spring-type contact 1 is also positioned simultaneously along with the fabrication of the support 10 during an injection-molding process, thereby eliminating the need for subsequent mounting of the spring-type contact 1 after manufacture of the support 10.

Figure 6:
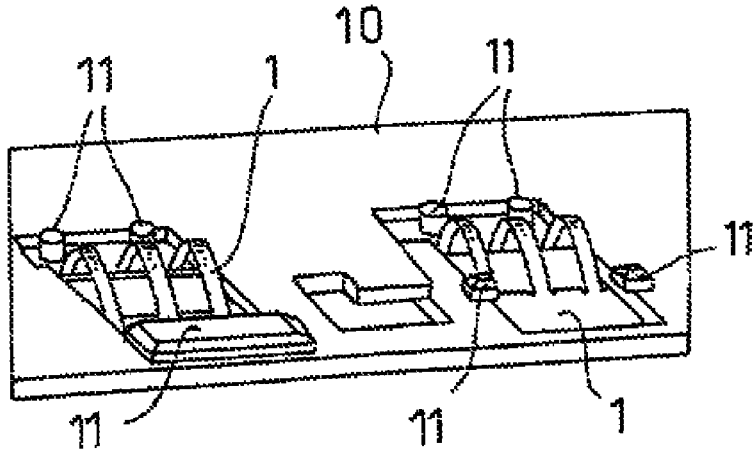
FIG. 6 shows a support frame (for example, support 10) in which the at least one spring-type contact is mounted and in which limit stops are integrated to provide a limit for spring travel.

FIG. 6 shows that limit stops providing a travel limit for the spring travel are integrated in the support frame used (for example, the support 10) in which the at least one spring-type contact is mounted. This is especially critical so that during transport and in the event the installed spring-type contacts are improperly handled they cannot be damaged. Preferably, these limit stops can be provided in the attachment and installation elements of the spring-type contact; however, they can also be anchored inexpensively to the support frame in the form of separate modules. The limit stops are identifiable in FIG. 6 at reference 11.

The invention claimed is:

1. In combination with a pair of confronting and spaced contact surfaces of a predetermined conductive material, a spring-type contact between the surfaces and having:

a support carrying one of the surfaces;

an anchored end secured to the support;

an opposite free end;

a plurality of blades unitary with and extending between the ends and each having a bowed section engaging a respective contact surface, the bowed sections of the contact extending in opposite directions toward the contact surfaces and forming contact points engageable with the contact surfaces; and a coating on each of the contact points and of a material matched to the conductive material of the respective contact surfaces.

2. The spring-type contact according to claim 1 wherein based on a design shape or on a corresponding design shape of the one contact surface, the anchored end can be anchored only in one predetermined position relative to the one contact surface by or positive engagement.

3. The spring-type contact according to claim 1, further comprising limit stops that define a travel limit for movement of the free end relative to the other contact surface.

4. The spring-type contact according to claim 1 wherein based on a design shape of the one contact surface, the anchored end can be anchored only in one predetermined position relative to the one contact surface.

5. The spring-type contact according to claim 1 wherein one of the contact surfaces is a two-dimensional component of a vehicle, and the other contact surface is a printed-circuit board of an electronic device.

6. The spring-type contact according to claim 5 wherein the two-dimensional component is an antenna conductor structure and the electronic device is an antenna amplifier.

7. A spring-type contact wherein a first plurality of the blades have bowed sections convex toward one of the contact surfaces and a second plurality of the blades have bowed sections convex toward the other of the contact surface and a number or a width of the blades of the first plurality is different from a number or a width of the blades of the second plurality.

8. The spring-type contact according to claim 7, further comprising limit stops that define a travel limit for spring travel of the anchored end in the one contact surface.

* * * * *